US011241714B2

(12) United States Patent
Satou et al.

(10) Patent No.: US 11,241,714 B2
(45) Date of Patent: Feb. 8, 2022

(54) FLAME TREATMENT DEVICE, APPARATUS FOR PRODUCING COATED METAL PLATE, AND METHOD FOR PRODUCING COATED METAL PLATE

(71) Applicant: NIPPON STEEL CORPORATION, Tokyo (JP)

(72) Inventors: Masaki Satou, Tokyo (JP); Seiju Suzuki, Tokyo (JP); Shuichi Sugita, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/963,912

(22) PCT Filed: Jan. 17, 2019

(86) PCT No.: PCT/JP2019/001168
§ 371 (c)(1),
(2) Date: Jul. 22, 2020

(87) PCT Pub. No.: WO2019/146473
PCT Pub. Date: Aug. 1, 2019

(65) Prior Publication Data

US 2021/0039132 A1 Feb. 11, 2021

(30) Foreign Application Priority Data

Jan. 26, 2018 (JP) ..... JP2018-011809

(51) Int. Cl.
*B05D 3/08* (2006.01)
*B05C 9/14* (2006.01)
(Continued)

(52) U.S. Cl.
CPC ..... *B05D 3/08* (2013.01); *B05C 9/14* (2013.01); *B05D 7/14* (2013.01); *C23G 5/04* (2013.01);
(Continued)

(58) Field of Classification Search
None
See application file for complete search history.

(56) References Cited

U.S. PATENT DOCUMENTS

2011/0311732 A1* 12/2011 Bignon ..... C03C 17/002 427/529
2016/0298838 A1* 10/2016 Karkow ..... F23N 5/006
(Continued)

FOREIGN PATENT DOCUMENTS

JP H1190313 4/1999
JP 2006102671 4/2006
(Continued)

OTHER PUBLICATIONS

International Search Report and Written Opinion from PCT/JP2019/001168 dated Feb. 19, 2019 (with English translation of ISR).

*Primary Examiner* — Nadine G Norton
*Assistant Examiner* — Bradford M Gates
(74) *Attorney, Agent, or Firm* — Calfee, Halter & Griswold LLP

(57) ABSTRACT

The present invention addresses the problem of providing a flame treatment device which is capable of performing a flame treatment on a metal-based base material without requiring a preheat treatment. For the purpose of solving the above-described problem, a flame treatment device according to the present invention comprises: a first temperature measurement unit which measures the temperature of a metal-based base material before a flame treatment; a control unit which determines the combustion energy of flame
(Continued)

on the basis of the temperature before a flame treatment, said temperature having been measured by the first temperature measurement unit, so that the surface temperature of the metal-based base material during the flame treatment is 56° C. or higher; and a flame treatment unit which performs a flame treatment on the metal-based base material on the basis of the combustion energy, which has been determined by the control unit.

12 Claims, 3 Drawing Sheets

(51) Int. Cl.
*B05D 7/14* (2006.01)
*C23G 5/04* (2006.01)

(52) U.S. Cl.
CPC ..... *B05D 2202/15* (2013.01); *B05D 2202/25* (2013.01)

(56) References Cited

U.S. PATENT DOCUMENTS

2018/0161809 A1* 6/2018 Satou ..... B05C 9/14
2018/0169695 A1* 6/2018 Satou ..... B41M 5/508

FOREIGN PATENT DOCUMENTS

WO 2016/199802 12/2016
WO 2016/199803 12/2016

* cited by examiner

FLAME TREATMENT DEVICE, APPARATUS FOR PRODUCING COATED METAL PLATE, AND METHOD FOR PRODUCING COATED METAL PLATE

RELATED APPLICATIONS

The present application is a 35 U.S.C. 371 U.S. national stage application entry of PCT International Application No. PCT/JP2019/001168, filed on Jan. 17, 2019, which claims the benefit of Japanese Patent Application No. 2018-011809, filed Jan. 26, 2018, the entire disclosures of which are incorporated herein by reference.

TECHNICAL FIELD

The present invention relates to a flame treatment apparatus, an apparatus for producing a coated metal plate, and a method for producing a coated metal plate.

BACKGROUND ART

The functionality and design of a metal plate have been improved by using a coating material and ink each containing a resin on the metal plate, thereby enhancing added value. When stains, dust, or the like adheres to a metal plate to be coated or printed, desired coating becomes difficult due to a decrease in adhesion between the metal plate and a coating film and a change in wettability of the metal plate. Therefore, flame treatment of the metal plate before coating is investigated. For example, Patent Literature 1 discloses a method including heating a steel pipe to 100° C. or more, removing moisture, dust, oil and fat, etc. adhering to the surface by using a burner flame, and then coating the steel pipe with a coating agent.

On the other hand, a coated metal plate is often used for outdoor buildings, civil engineering structures, and the like. Such a coated metal plate has a stain problem caused by adhesion of carbon-based contaminants contained in exhaust gas of automobiles, smoke and the like generated from factories, etc. In particular, stains (also referred to as "rain-streak stains" hereinafter) adhering along rain streaks are noticeable. The rain-streak stains on a coated metal plate in the related art cannot be avoided from becoming noticeable within a relatively short time, and thus there is a demand for providing a method for producing a coated metal plate which does not easily cause the rain-streak stains.

Therefore, it has recently been proposed to prevent the rain-streak stains by adjusting the contact angle with water of a coating film to 60° or less, that is, hydrophilization of the coating film. A method proposed as a method for enhancing the hydrophilicity of a coating film includes coating a metal plate with a coating material containing organosilicate or the like together with a polyester resin or the like, and then performing flame treatment, plasma treatment, corona discharge treatment, or the like of the coating film (Patent Literature 2).

CITATION LIST

Patent Literature

PTL 1
Japanese Patent Application Laid-Open No. H11-90313
PTL 2
Japanese Patent Application Laid-Open No. 2006-102671

SUMMARY OF INVENTION

Technical Problem

Herein, flame treatment commonly uses a burner using liquefied petroleum gas (LPG) or liquefied natural gas (LNG) as a fuel, and for example, when liquefied petroleum gas combusts, chemical reaction represented by the following chemical formula takes place.

$$C_3H_8(LPG)+5O_2 \rightarrow 3CO_2+4H_2O+heat$$

The chemical formula indicates that water is generated by combustion of the fuel. On the other hand, a metal-based base material has high thermal conductivity. Therefore, in flame treatment of the metal-based base material, heat is rapidly diffused at the moment when a flame comes into contact with the metal-based base material, and thus the surface temperature of the metal-based base material is hardly increased. Consequently, the water generated by combustion of the fuel is cooled and dew-condensed on the surface of the metal-based base material. The occurrence of dew condensation hinders the flame treatment, and thus there is the problem that the desired effects described in Patent Literature 1 and Patent Literature 2 cannot be obtained.

Thus, preheating treatment or the like of the metal-based base material before the flame treatment is also investigated. On the other hand, the preheating treatment requires a heater or the like for preheating treatment, and thus there is the problem of further complicating the process.

The present invention has been achieved in consideration of the problems. Specifically, an object of the present invention is to provide a flame treatment apparatus capable of flame treatment of a metal-based base material without preheating treatment, an apparatus for producing a coated metal plate, and a method for producing a coated metal plate.

Solution to Problem

A first aspect of the present invention relates to the following flame treatment apparatus.

[1] A flame treatment apparatus, comprising: a first temperature measuring section that measures a temperature before flame treatment of a metal-based base material; a control section that, based on the temperature before flame treatment measured by the first temperature measuring section, determines flame combustion energy so that a surface temperature of the metal-based base material is 56° C. or more during flame treatment; and a flame treatment section that, based on the combustion energy determined by the control section, flame-treats the metal-based base material.

[2] The flame treatment apparatus according to [1], further comprising a second temperature measuring section that measures a temperature after flame treatment of the metal-based base material, wherein: the control section determines the combustion energy based on the temperature before flame treatment and the temperature after flame treatment.

[3] The flame treatment apparatus according to [2], further comprising a humidity measuring section that measures outdoor air humidity, wherein: the control section determines the combustion energy based on the outdoor air humidity, the temperature before flame treatment, and the temperature after flame treatment.

[4] The flame treatment apparatus according to any one of [1] to [3], further comprising a conveyance section that conveys the metal-based base material, wherein: the first temperature measuring section and the second temperature measuring section are disposed in this order along a conveyance direction of the conveyance section.

A second aspect of the present invention relates to the following apparatus for producing a coated metal plate.

[5] An apparatus for producing a coated metal plate, comprising: a coating film forming section that forms a coating film by coating a metal plate with a coating material; and the flame treatment apparatus according to any one of [1] to [4], wherein: the flame treatment apparatus performs flame treatment of the coating film formed by the coating film forming section.

A third aspect of the present invention relates to the following method for producing a coated metal plate.

[6] A method for producing a coated metal plate, comprising: forming a coating film on a metal plate having a thermal conductivity of 10 W/mK or more by coating the metal plate with a coating material; first measuring a temperature of the metal plate including the coating film formed on the metal plate; and determining flame combustion energy based on the temperature measured in the first measuring of the temperature so that a surface temperature of the coating film is 56° C. or more during flame treatment and then performing flame treatment.

[7] The method for producing a coated metal plate according to [6], wherein: the flame treatment includes determining the combustion energy based on the temperature measured in the first measuring of the temperature and the thermal conductivity of the metal plate.

[8] The method for producing a coated metal plate according to [6] or [7], wherein: the flame treatment is performed so that the surface temperature of the coating film is 56° C. or more and 150° C. or less during the flame treatment.

[9] The method for producing a coated metal plate according to [6], further comprising second measuring the temperature of the metal plate including the coating film formed on the metal plate after the flame treatment, wherein: the flame treatment includes determining the combustion energy based on at least the temperature measured in the first measuring of the temperature and the temperature measured in the second measuring of the temperature.

[10] The method for producing a coated metal plate according to [9], further comprising measuring outdoor air humidity, wherein: the flame treatment includes determining the combustion energy based on at least the temperature measured in the first measuring of the temperature, the temperature measured in the second measuring of the temperature, and the humidity measured in the measuring of the humidity.

[11] The method for producing a coated metal plate according to [6], wherein: the flame treatment is performed while the metal plate including the coating film formed on the metal plate is conveyed in a constant direction; and the flame treatment includes determining the combustion energy based on at least the temperature measured in the first measuring of the temperature and conveyance speed of the metal plate.

[12] The method for producing a coated metal plate according to [6], wherein:

the flame treatment includes determining the combustion energy based on at least the temperature measured in the first measuring of the temperature and a type of a combustion gas supplied during the flame treatment.

[13] The method for producing a coated metal plate according to any one of [6] to [12], wherein: the coating material contains a silicone resin.

Advantageous Effects of Invention

A flame treatment apparatus of the present invention enables flame treatment without preheating treatment of a metal-based base material without causing dew condensation of moisture generated by fuel combustion.

DESCRIPTION OF EMBODIMENTS

1. Flame Treatment Apparatus

A flame treatment apparatus of the present invention is an apparatus for flame treatment of a metal-based base material. The flame treatment apparatus of the present invention is an apparatus for flame treatment of a member easily causing dew condensation during flame treatment, that is, a member including a member having high thermal conductivity, and is very useful for flame treatment of a metal-based base material including a metal plate having a thermal conductivity of 10 W/mK or more. A flame treatment apparatus according to an embodiment of the present invention will be described in detail below with reference to the drawings.

Figure 1:
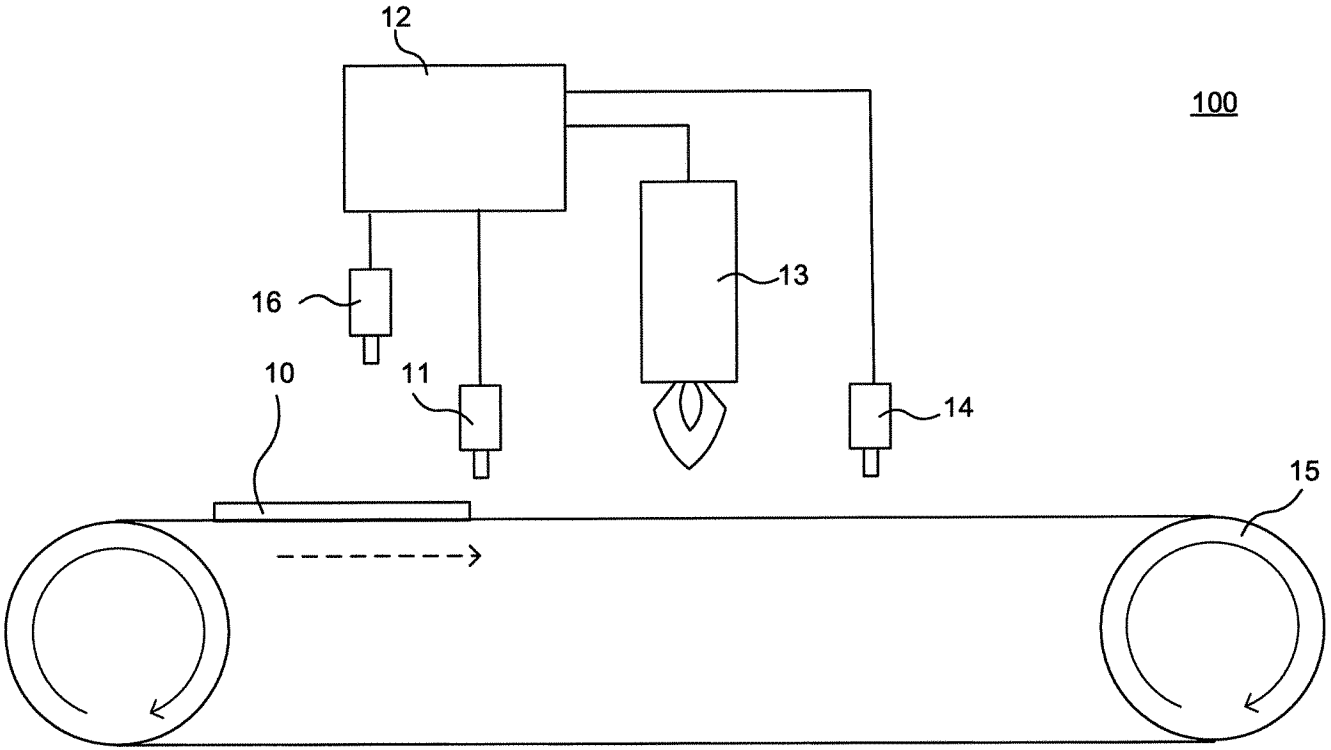
FIG. 1 is a side view of a flame treatment apparatus.

FIG. 1 indicates a side view of a flame treatment apparatus according to the present embodiment. Flame treatment apparatus 100 according to the present embodiment includes conveyance section 15 for conveying metal-based base material 10, first temperature measuring section 11 which measures the temperature before flame treatment of metal-based base material 10, second temperature measuring section 14 which measures the temperature after flame treatment of metal-based base material 10, humidity measuring section 16 for measuring outdoor air humidity, control section 12 which determines the combustion energy of a flame so that the surface temperature of metal-based base material 10 is 56° C. or more during flame treatment based on the temperature before flame treatment, the temperature after flame treatment, the outdoor air humidity, etc., and flame treatment section 13 for flame treatment of metal-based base material 10 based on the combustion energy determined by control section 12. In the specification of the present invention, the combustion energy of a flame is the total heat amount of the flame radiated per unit area of metal-based base material 10.

The type of conveyance section 15 is not particularly limited as long as metal-based base material 10 can be conveyed at a constant speed, and for example, a known conveyor including a metal-made endless belt and a drive section which rotates the belt at a constant speed can be used. The conveyance speed of metal-based base material 10 by conveyance section 15 may be controlled by conveyance section 15 itself or may be controlled by control section 12 described below.

First temperature measuring section 11 is a section for measuring the temperature before flame treatment of a surface to be flame-treated of metal-based base material 10 and outputting the temperature to control section 12. First temperature measuring section 11 can be configured by one or more temperature sensors disposed on the upstream side of flame treatment section 13 described below in the conveyance direction of metal-based base material 10. In the specification of the present invention, the temperature before flame treatment of metal-based base material 10 represents the temperature of metal-based base material 10 in a state within 30 seconds until the start of flame treatment.

On the other hand, second temperature measuring section 14 is a section for measuring the temperature after flame treatment of metal-based base material 10 and outputting the temperature to control section 12. Second temperature measuring section 14 can be configured by one or more temperature sensors disposed on the downstream side of flame treatment section 13 described below in the conveyance direction of metal-based base material 10. In the specification of the present invention, the temperature after flame treatment of metal-based base material 10 represents the temperature of metal-based base material 10 in a state within 20 seconds from the finish of flame treatment.

The type of each of first temperature measuring section 11 and second temperature measuring section 14 is not particularly limited and may be a contact-type temperature sensor or the like, but in the present embodiment, a noncontact type temperature sensor is used from the viewpoint that the temperature can be measured without damaging metal-based base material 10.

Although, in the present embodiment, each of first temperature measuring section 11 and second temperature measuring section 14 includes only one temperature sensor, first temperature measuring section 11 and/or second temperature measuring section 14 may be configured by a plurality of temperature sensors. When first temperature measuring section 11 or second temperature measuring section 14 is configured by a plurality of temperature sensors, they can be arranged in a line perpendicular to the conveyance direction. This arrangement of a plurality of temperature sensors can grasp variation in the temperature before flame treatment or the temperature after flame treatment in the direction perpendicular to the conveyance direction of metal-based base material 10.

In flame treatment apparatus 100 according to the present embodiment, first temperature measuring section 11 and second temperature measuring section 14 are disposed on the side of a surface to be flame-treated of metal-based base material 10, but these may be disposed on the side (also referred to as the "back side" hereinafter) opposite to the surface to be flame-treated of metal-based base material 10. During flame treatment by flame treatment section 13, water vapor and carbon dioxide are generated by fuel combustion. Thus, when they are present between first temperature measuring section 11 and the second temperature measuring section 14 and flame treatment section 13, the temperature may not be correctly measured. On the other hand, when first temperature measuring section 11 and second temperature measuring section 14 are disposed on the back surface side of metal-based base material 10, the temperature can be correctly measured because of little influence of water vapor and carbon dioxide. The temperature of the back surface of metal-based base material 10 may be different from the temperature of the surface to be flame-treated depending on the thickness and thermal conductivity of metal-based base material 10. Thus, in this case, the temperature of the surface side to be flame-treated of metal-based base material 10 may be calculated from the temperature of the back surface of metal-based base material 10 according to arithmetic processing by control section 12 described below.

On the other hand, humidity measuring section 16 contained in flame treatment apparatus 100 according to the present embodiment may be a section capable of measuring outdoor air humidity, and a known humidity sensor or the like can be used. In flame treatment section 13 described below, a flame is generated by mixing combustion gas with supporting gas. A large amount of moisture contained in the supporting gas easily causes dew condensation during flame treatment. Therefore, in the present embodiment, the combustion energy of flame is determined by control section 12 in consideration of the outdoor air humidity.

The humidity measured by humidity measuring section 16 is not particularly limited as long as it is the humidity near flame treatment apparatus 100. Meanwhile, there is the possibility that the humidity near flame treatment section 13 is changed by fuel combustion. Thus, humidity measuring section 16 preferably measures the humidity at a portion hardly influenced by the flame in flame treatment section 13. Although, in the present embodiment, humidity measuring section 16 is disposed on the upstream side of flame treatment section 13, humidity measuring section 16 may be disposed on the downstream side of flame treatment section 13 or may be disposed near a supporting gas inlet of flame treatment section 13. Further, although in the present embodiment, humidity measuring section 16 includes only one humidity sensor, humidity measuring section 16 may include a plurality of humidity sensors.

On the other hand, the configuration of control section 12 according to the present embodiment is not particularly limited as long as it includes a treatment section which can receive the temperature before flame treatment of metal-based base material 10 measured by first temperature measuring section 11, the temperature after flame treatment of metal-based base material 10 measured by second temperature measuring section 14, and the outdoor air humidity measured by humidity measuring section 16, and which can, based on these, determine the flame combustion energy so that the surface temperature of the metal-based base material is 56° C. or more during flame treatment and control the combustion energy in flame treatment section 13. Control section 12 may determine the combustion energy according to not only the temperature before flame treatment of metal-based base material 10, the temperature after flame treatment of metal-based base material 10, and the outdoor air humidity but also the type of the combustion gas supplied to flame treatment section 13, the conveyance speed of metal-based base material 10 by conveyance section 15, and further the thickness and the like of metal-based base material 10. When the combustion energy is determined so that the surface temperature of metal-based base material 10 is 56° C. or more during flame treatment, little dew condensation occurs on the surface of metal-based base material 10.

Control section 12 may include, other than the treatment section described above, an input section for inputting information such as the thermal conductivity and the like of the metal-based base material 10, a display section for displaying various items of information, a storage section for storing various items of information including a control program executed in control section 12.

Herein, the arrangement position of control section 12 is not particularly limited as long as the arrangement position is a position where control section 12 can give and receive data to and from first temperature measuring section 11, flame treatment section 13, second temperature measuring section 14, humidity measuring section 16, conveyance section 15, etc.

On the other hand, flame treatment section 13 is a section which performs flame treatment of metal-based base material 10 according to the combustion energy determined by control section 12 described above. In the present embodiment, flame treatment section 13 includes a combustion gas supply source, a supporting gas supply source, a gas mixing section for mixing the combustion gas with the supporting gas, a gas supply pipe for supplying combustible gas (mixed gas of the combustion gas and the supporting gas), and a burner head for burning the combustible gas supplied from the gas supply pipe, but may include a configuration other than this.

Figure 2A:
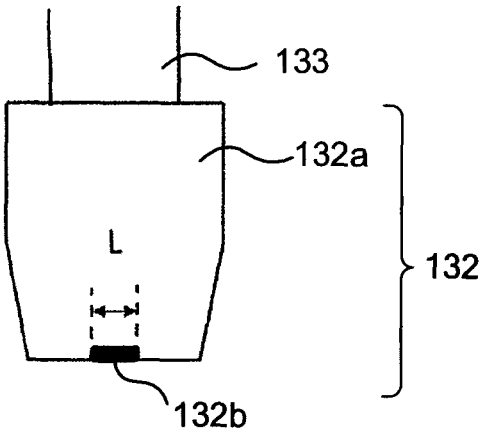
FIG. 2A is a side view of a burner head of a burner for flame treatment.
Figure 2B:
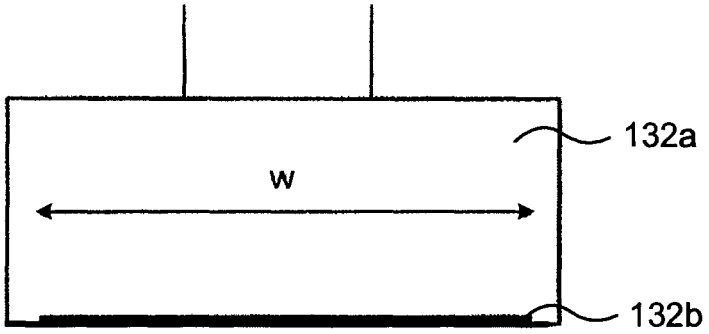
FIG. 2B is a front view of the burner head.
Figure 2C:
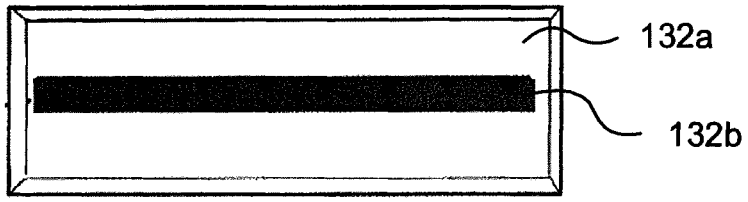
FIG. 2C is a bottom view of the burner head.

FIG. 2A is a side view of burner head 132 of flame treatment section 13 indicated in FIG. 1, FIG. 2B is a front view, and FIG. 2C is a bottom view. Burner head 132 is not particularly limited as long as burner head 132 includes housing 132*a* connected to gas supply pipe 133 and flame hole 132*b* disposed in a surface of housing 132*a*, and as long as the combustible gas supplied from gas supply pipe 133 can be burned in flame hole 132*b*. In addition, in FIG. 2A and FIG. 2B, a portion corresponding to flame hole 132*b* is emphasized by a thick line for the convenience sake, but flame hole 132*b* cannot be actually visually recognized from the side and front surfaces.

Flame hole 132*b* is a through hole provided in the bottom of housing 132*a*. The shape of flame hole 132*b* is not particularly limited, but a rectangular shape or a circular hole shape can be used. From the viewpoint of uniformly performing flame treatment perpendicularly to the conveyance direction of metal-based base material 10, a rectangular shape is particularly preferred. Also, the width (width denoted by W in FIG. 2B) of flame hole 132*b* perpendicular to the conveyance direction of metal-based base material 10 may be equal to or larger than the width of metal-based base material 10 to be flame-treated, and can be set to, for example, about 50 to 150 cm. On the other hand, the width (width denoted by L in FIG. 2A) of flame hole 132*b* parallel to the conveyance direction of metal-based base material 10 can be properly set according to discharge stability of combustible gas and the like, and can be set to, for example, about 1 to 8 mm. A burner having a burner head having this configuration is commercially available, and examples thereof include Flynn Burner Corporation (USA) product name "F-3000", Finecom I & T Co., Ltd. (Korea) product name "FFP250", and the like.

In addition, one of the ends of the gas supply pipe contained in flame treatment section 13 is connected to burner head 132, and the other is connected to the gas mixing section. The gas mixing section is a member which is connected to a combustion gas supply source such as a combustion gas cylinder or the like, and a supporting gas supply source such as an air cylinder, an oxygen cylinder, compressor air or blower air, or the like, and which premixes the combustion gas and the supporting gas. In order to make constant the oxygen concentration in the combustible gas supplied to the gas supply pipe from the gas mixing section, flame treatment section 13 may be provided with an oxygen supplier for supplying oxygen to the gas supply source according to demand.

Burner head 132 of flame treatment section 13 is disposed above conveyance section 15 so as to be spaced from the upper surface of conveyance section 15, and a flame is discharged from the flame hole to metal-based base material 10 passing between conveyance section 15 and burner head 132. The distance between burner head 132 and metal-based base material 10 is properly selected according to the combustion energy, the thickness of metal-based base material 10, and the like. The distance between the flame hole of burner head 132 and the surface to be flame-treated of metal-based base material 10 is generally preferably about 10 to 120 mm, more preferably about 10 to 80 mm, and still more preferably about 20 to 50 mm. When the distance between burner head 132 and metal-based base material 10 is excessively short, metal-based base material 10 may come into contact with burner head 132 due to curvature or the like of metal-based base material 10. While, when the distance between burner head 132 and metal-based base material 10 is excessively large, much energy is required for flame treatment. Although in the present embodiment, burner head 132 is disposed so as to radiate a flame perpendicularly to the surface of metal-based base material 10, burner head 132 may be disposed so as to radiate a flame at a constant angle with the surface of metal-based base material 10.

A flame treatment method using flame treatment apparatus 100 according to the present embodiment is described below. In flame treatment using flame treatment apparatus 100 of the present embodiment, first metal-based base material 10 is conveyed at a constant speed in a constant direction by conveyance section 15. In this case, the conveyance speed of metal-based base material 10 is properly selected according to the desired combustion energy, but can be generally determined to 5 to 150 m/min, more preferably 20 to 100 m/min, and still more preferably 30 to 80 m/min. The conveyance of metal-based base material 10 at a speed of 5 m/min or more enables efficient flame treatment, and, in addition, can further suppress an excessive increase in temperature of metal-based base material 10. While the excessive high conveyance speed of metal-based base material 10 easily causes an air flow due to the movement of metal-based base material 10, and may cause variation in flame treatment.

Then, humidity measuring section 16 measures the outdoor air humidity and outputs the humidity to control section 12 (humidity measurement). Humidity measuring section 16 may continuously measures the humidity or measure the humidity according to demand. In addition, first temperature measuring section 11 measures the temperature of the surface to be flame-treated or the back surface of metal-based base material 10 conveyed by conveyance section 15 and outputs the temperature to control section 12 (first temperature measurement). First temperature measuring section 11 may continuously measure the temperature of the surface to be flame-treated or the back surface of metal-based base material 10 or may intermittently measure the temperature at a constant interval.

Control section 12 which receives the humidity and the temperature before flame treatment from humidity measuring section 16 and first temperature measuring section 11, respectively, determines the combustion energy based on the previously input information (thermal conductivity, thickness, etc.) of metal-based base material 10, the humidity, the temperature before flame treatment, etc. and controls flame treatment section 13 (flame treatment). The combustion energy may be determined in further consideration of the conveyance speed of metal-based base material 10, the type of the combustion gas supplied to flame treatment section 13, etc. In a specific method, at the same time as start of flame treatment, an amount of heat necessary for increasing the temperature of the surface to be flame-treated of metal-based base material 10 to 56° C. or more is calculated by control section 12 with comparison and reference to the temperature before flame treatment and humidity, a calibration curve previously formed for metal-based base material 10, etc. Further, an amount of heat necessary for surface treatment of metal-based base material 10 and an amount of heat necessary for increasing the temperature of metal-based base material 10 are added up, and based on the total as the combustion energy, flame treatment is performed in flame treatment section 13. In particular, the calibration curve may be formed according to the conveyance speed of metal-based base material 10 and the type of the combustion gas. By using this calibration curve, the surface temperature of metal-based base material 10 can be more correctly controlled to 56° C. or more during flame treatment. In addition, based on the combustion energy, the amount or the like of gas supplied from the gas supply pipe of flame treatment section 13 is adjusted, and the amount of flame radiated to metal-based base material 10 is adjusted. The method for controlling flame treatment section 13 according to the combustion energy is not limited to adjustment of the amount of gas supplied, and the method may be, for example, a method of changing the distance between the flame hole of burner head 132 of flame treatment section 13 and the surface to be flame-treated of metal-based base material 10, or the like. Herein, the output of flame radiated from flame treatment section 13 is preferably adjusted within a range of 250 kJ/hour to 14000 kJ/hour, more preferably within a range of 1000 kJ/hour to 12000 kJ/hour, and still more preferably within a range of 2000 kJ/hour to 10000 kJ/hour per width of 10 mm of the flame hole of burner head 132. With the output of less than 250 kJ/hour per width of 10 mm of the flame hole, it is difficult to perform flame treatment while instantly increasing the temperature of metal-based base material 10 to 60° C. or more. While with the output of over 14000 kJ/hour per width of 10 mm of the flame hole, the shape of the flame is made unstable due to the excessively high flow rate of the combustion gas, and thus failure such as nonuniformity of treatment or the like may occur.

In addition, examples of the gas burned in flame treatment section 13 include hydrogen, liquefied petroleum gas (LPG), liquefied natural gas (LNG), acetylene gas, propane gas, butane, and the like. Among these, from the viewpoint of easily forming a desired flame, LPG or LNG is preferred, and LPG is particularly preferred. Examples of the supporting gas include air and oxygen, and from the viewpoint of handleability and the like, air is preferred.

The mixing ratio of the combustion gas to the supporting gas in the combustible gas supplied to burner head 132 through the gas supply section can be properly determined according to the types of the combustion gas and the supporting gas. For example, when the combustion gas is LPG and the supporting gas is air, the volume of air relative to 1 volume of LPG is preferably 24 to 27, more preferably 25 to 26, and still more preferably 25 to 25.5. When the combustion gas is LNG and the supporting gas is air, the volume of air relative to 1 volume of LNG is preferably 9.5 to 11, more preferably 9.8 to 10.5, and still more preferably 10 to 10.2.

On the other hand, in flame treatment apparatus 100 of the present embodiment, the temperature after flame treatment of metal-based base material 10 after flame treatment by flame treatment section 13 is measured by second temperature measuring section 14 and is output to control section 12. That is, it is recognized from the temperature after flame treatment whether or not the temperature after flame treatment is within a desired range (for example, 56° C. or more in the case of measurement from the surface side to be flame-treated, and 56° C. or more in the case of measurement from the back side depending on the thermal conductivity of metal-based base material 10, the strength of the flame radiated from flame treatment section 13, and the like), and then the flame treatment conditions are properly corrected by control section 12. Second temperature measuring section 14 may continuously measure the temperature of the surface to be flame-treated or the back surface of metal-based base material 10 or may measure the temperature according to demand.

Other

The above description is made of the embodiment in which the combustion energy is determined by the control section based on the temperature before flame treatment measured by the first temperature measuring section, the temperature after flame treatment measured by the second temperature measuring section, the humidity measured by the humidity measuring section, the thermal conductivity of the metal-based base material, the thickness of the metal-based base material, the conveyance speed of the metal-based base material by the conveyance section, the type of the combustion gas, etc., but the combustion energy may be determined by the control section based on only the temperature before flame treatment measured by the first temperature measuring section. In this case, if required, the combustion energy may be corrected with reference to the temperature after flame treatment and the humidity. Also, the flame treatment apparatus may not include the humidity measuring section and the second temperature measuring section. In addition, the combustion energy may be determined based on any combination of two or more of the temperature before flame treatment, the temperature after flame treatment, the humidity, the thermal conductivity of the metal-based base material, the thickness of the metal-based base material, the conveyance speed of the metal-based base material, and the type of the combustion gas.

Further, although the present embodiment describes, as an example, a case in which metal-based base material 10 has a plate shape, metal-based base material 10 may have a coiled shape or the like. Also, the thickness and width are not particularly limited and are properly selected according to the type and application of metal-based base material 10.

Effect

As described above, a flame treatment apparatus in the related art has the problem of easily causing dew condensation of water generated on the surface of the metal-based base material by fuel combustion during flame treatment of the metal-based base material, thereby failing to satisfactorily perform flame treatment of the metal-based base material. Also, the metal-based base material is pre-heated or the like before flame treatment in order to suppress dew condensation, but there is the problem from the viewpoint of enlargement of the treatment apparatus, complication of the process, etc.

On the other hand, the flame treatment apparatus of the present invention includes the control section which determines the combustion energy so that the surface temperature of the metal-based base material is 56° C. or more during flame treatment. That is, the flame treatment apparatus of the present invention performs flame treatment so that the surface temperature of the metal-based base material is 56° C. or more at the same time as start of flame treatment. Therefore, even when water is generated by fuel combustion, little dew condensation occurs on the surface of the metal-based base material, and thus flame treatment is hardly inhibited. As a result, for example, it becomes possible to efficiently perform hydrophilization treatment of the metal-based base material, removal of dust, oil and fat, and the like adhering to the surface of the metal-based base material, and the like.

2. Apparatus for Producing Coated Metal Plate

An apparatus for producing a coated metal plate of the present invention is an apparatus for producing a coated metal plate having a coating film on a metal plate, which can be configured to include a coating film forming section for forming a coating film by coating the metal plate with the coating material and a flame treatment apparatus for flame treatment of the coating film.

The type of the metal plate used for producing the coated metal plate is not particularly limited, but as described above, a metal-based base material containing a metal plate having a thermal conductivity of 10 W/mK or more easily causes dew condensation on the surface thereof during flame treatment. Thus, the apparatus for producing a coated metal plate of the present invention is very useful for producing the coated metal plate by forming a coating film on a metal plate having a thermal conductivity of 10 W/mK or more.

Examples of the type of the metal plate include, but are not particularly limited to, plated steel plates such as a hot-dip Zn-55% Al alloy plated steel plate and the like; steel plates such as a usual steel plate, a stainless steel plate, and the like; an aluminum plate; a copper plate; and the like. Also, a chemical conversion film, an undercoating film, or the like may be formed on the surface of the metal plate within a range which does not impair the effect of the present invention. Further, roughening such as embossing, drawing, or the like may be performed on the metal plate within a range which does not impair the effect of the present invention.

Figure 3:
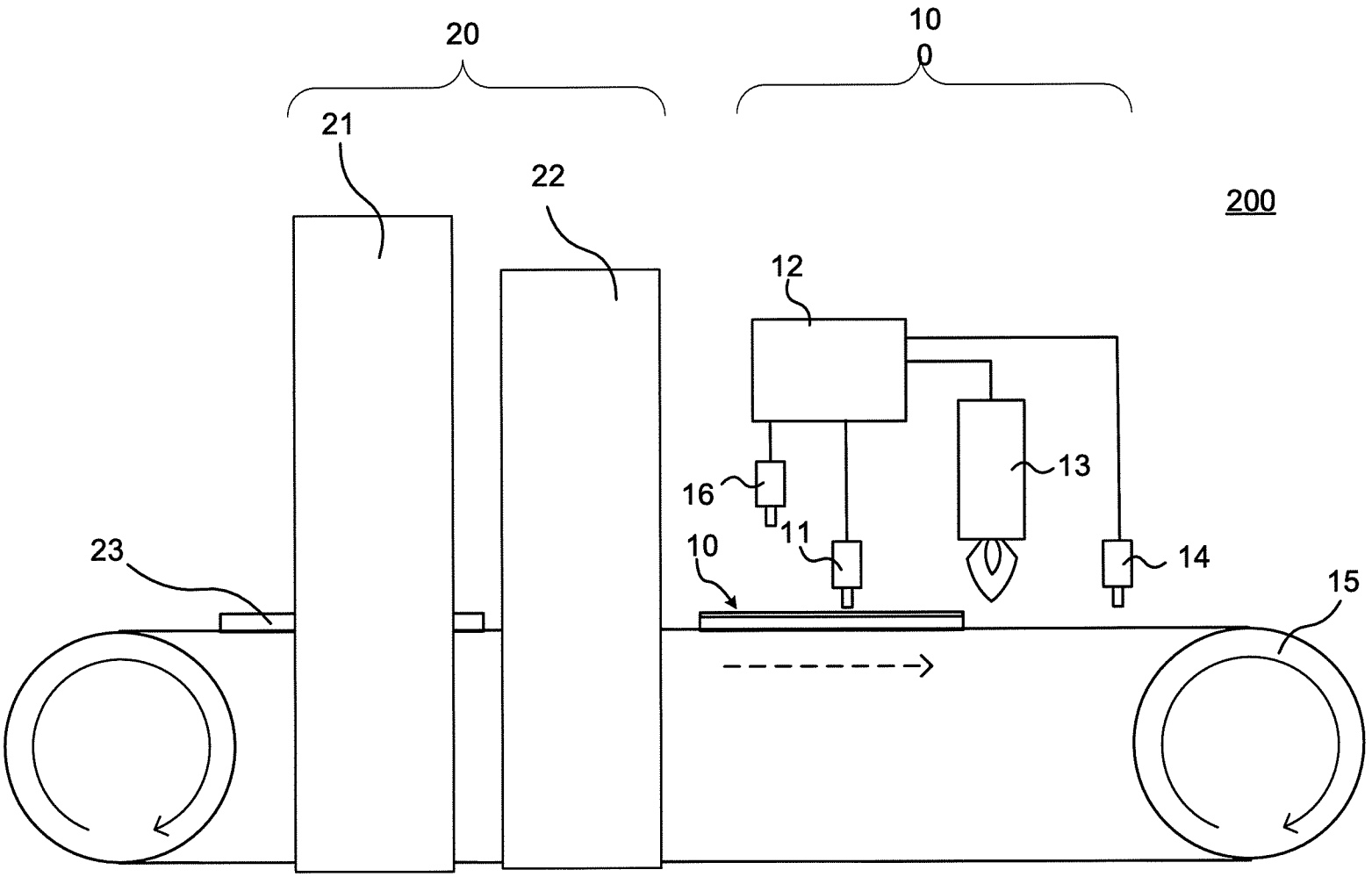
FIG. 3 is a side view of an apparatus for producing a coated metal plate.

Also, the type of the coating material coated on the metal plate is not particularly limited, but a coated metal plate having high surface hydrophilicity and causing little rain-streak stain can be produced by coating the metal plate with a coating material containing a silicone resin described below and then flame-treating the coating film. An apparatus for producing a coated metal plate according to an embodiment of the present invention is described in detail below with reference to FIG. 3, but the present invention is not limited to the embodiment.

Apparatus 200 for producing a coated metal plate according to the present embodiment includes coating film forming section 20 for forming a coating film on metal plate 23 and flame treatment apparatus 100 for flame treatment of the coating film formed by coating film forming section 20. Although in apparatus 200 for producing a coated metal plate according to the present embodiment, a conveyance section of coating film forming section 20 and conveyance section 15 of flame treatment apparatus 100 described above are common to each other, the conveyance section of coating film forming section 20 and the conveyance section of flame treatment apparatus 100 may be separately formed. In addition, apparatus 200 for producing a coated metal plate may include another component between coating film forming section 20 and flame treatment apparatus 100. In this case, flame treatment apparatus 100 contained in apparatus 200 for producing a coated metal plate according to the present embodiment is the same as flame treatment apparatus 100 described above, and thus each of the components is denoted by the same reference numeral and is not described.

Coating film forming section 20 in apparatus 200 for producing a coated metal plate according to the present embodiment includes coating section 21 for coating a coating material and solidification section 22 for solidifying the coating material. Coating section 21 is a section for coating the coating material on metal plate 23, and the present embodiment uses a roll coater. The type of coating section 21 is not limited to the roll coater and is properly selected according to the type of the coating material, and the type, size, shape, and the like of the metal plate. Coating section 21 may be, for example, a known spin coater, curtain coater, spray coater, dip coater, or ink jet apparatus, or the like. On the other hand, solidification section 22 is a section for solidifying the coating material coated by coating section 21, and the present embodiment uses an oven. Also, solidification section 22 (oven) according to the present embodiment has an air blowing function capable of blowing air so that the air speed at the plate surface is 0.9 m/s or more in order to solidify the coating material within a short time. While, the type of solidification section 22 is not particularly limited to the oven and is properly selected according to the type of the coating material, and when the coating material is ultraviolet curable or the like, solidification section 22 may be an ultraviolet irradiation section or the like.

A method for producing a coated metal plate by using the apparatus for producing a coated metal plate according to the present embodiment is described below. The method for producing a coated metal plate by using apparatus 200 for producing a coated metal plate according to the present embodiment includes first conveying metal plate 23 at a constant speed in a constant direction by conveyance section 15. The conveyance speed of metal plate 23 can be set to the same as the conveyance speed of metal-based base material 10 in flame treatment apparatus 100 described above. Then, in coating section 21, the surface of metal plate 23 conveyed by conveyance section 15 is coated with the coating material (coating material coating). In this case, the coating film thickness is properly selected according to the type of the coated metal plate, and coating is preferably performed so that the thickness of the film (coating film) after solidification is about 3 to 30 μm. The thickness is the value determined by a weight method from the specific gravity of the coating film and a difference in weight of the coated metal plate before and after removal of the coating film by sand blasting or the like. With the excessively thin coating film, the durability and hiding property of the coating film may become insufficient. While, with the excessively thick coating film, the production cost may be increased, and popping may occur during solidification.

The type of the coating material coated in coating section 21 is not particularly limited, but is preferably a coating material containing a silicone resin as described above. The coating material may further contain, according to demand, another resin, a curing agent, inorganic particles, organic particles, a coloring pigment, a solvent, or the like, other than the silicone resin. In the specification of the present invention, the "silicone resin" represents a compound produced by partial hydrolysis condensation of alkoxysilane, which is a polymer mainly having a three-dimensional crosslinked structure and being soluble in an organic solvent but not reaching gelation. The three-dimensional crosslinked structure contained in the silicone resin is not particularly limited and may be, for example, any one of a cage-like shape, a ladder-like shape, and a random shape. In the specification of the present invention, the silicone resin does not include tetraalkoxysilane and a condensate (organosilicate) produced by hydrolysis condensation of only tetraalkoxysilane.

The silicone resin has a three-dimensional crosslinked structure, and thus the silicone resin is transferred to the surface side of a film when metal plate 23 is coated with the coating material. Thus, when the film containing the silicone resin is flame-treated by flame treatment apparatus 100, organic groups (for example, a methyl group, a phenyl group, and the like) contained in the silicone resin are uniformly removed, thereby introducing a silanol group and a siloxane bond into the surface of the coating film. As a result, the hydrophilicity of the surface of the finally resultant coated metal plate is uniformly increased, and the rain-streak stain resistance becomes very good. In addition, the silicone resin is uniformly arranged on the surface of the coating film, thereby improving the scratch resistance of the coating film.

Herein, the weight-average molecular weight of the silicone resin contained in the coating material is preferably 700 to 50,000 and more preferably 1,000 to 10,000. With the silicone resin having a weight-average molecular weight of less than 700, the silicone resin is easily evaporated in solidification section 22, and thus solidification section 22 may be contaminated or the rain-streak stain resistance may be made unsatisfactory. While with the weight-average molecular weight of over 50,000, the viscosity of the coating material may be easily increased, thereby causing difficulty in uniform coating by coating section 21. The weight-average molecular weight of the silicone resin is a value in terms of polystyrene measured by gel permeation chromatography (GPC).

In addition, the coating material preferably contains 1 to 10 parts by mass and more preferably 2 to 6 parts by mass of silicone resin relative to 100 parts by mass of the solid content. When the coating material contains the silicone resin within the range, the hydrophilicity of the surface of the coating film after flame treatment is sufficiently enhanced, and thus the rain-streak stain resistance of the coated metal plate is improved. Also, the surface hardness of the coating film is enhanced.

On the other hand, the resin contained in the coating material may be any component which serves as a binder of the coating film. Examples of the resin include polymer compounds such as a polyester resin, a polyester urethane resin, an amino-polyester resin, an acrylic resin, an acrylic urethane resin, an amino-acrylic resin, a polyvinylidene fluoride resin, a polyurethane resin, an epoxy resin, a polyvinyl alcohol resin, a phenol resin, a fluorocarbon resin, and the like. Among these, in view of low stain adhesion, a polyester resin, a polyester urethane resin, an amino-polyester resin, an acrylic resin, an acrylic urethane resin, an amino-acrylic resin, and a polyvinylidene fluoride resin are preferred, and a polyester resin or acrylic resin is particularly preferred in view of high weather resistance.

The amount of the resin contained in the coating material is properly selected according to the type of the resin of the coated metal plate. From the viewpoint of strength or the like of the resultant coating film, the amount of the resin is preferably 25 to 60 parts by mass and more preferably 30 to 50 parts by mass relative to 100 parts by mass of the solid content.

In addition, the type and amount of a curing agent contained in the coating material according to demand are properly selected according to application of the coated metal plate and the type of the resin, and the amount is preferably 5 to 20 parts by mass and more preferably 7 to 15 parts by mass relative to 100 parts by mass of the resin. With the amount of the curing agent within the range, the hardness of the coating film formed by the coating material is improved.

Further, the coating material may contain known inorganic particles or organic particles. The average particle diameter of the particles is preferably 4 to 80 μm and more preferably 10 to 60 μm. The average particle diameter of inorganic particles or organic particles is a value measured by a Coulter counter method. The shape of inorganic particle and organic particles is not particularly limited, and from the viewpoint of easy adjustment of the surface state of the resultant coating film, a substantially spherical shape is preferred. In addition, the amount of inorganic particles and/or organic particles contained in the coating material is properly selected according to the surface state of the desired coating film etc., and is preferably 1 to 40 parts by mass in total relative to 100 parts by mass of the solid content of the coating material.

If required, the coating material may further contain a coloring pigment. The average particle diameter of the coloring pigment is, for example, 0.2 to 2.0 μm. If required, the coating material may further contain an organic solvent. The organic solvent is not particularly limited as long as it can sufficiently dissolve or disperse the silicone resin, the resin, the curing agent, the inorganic particles and organic particles, etc.

After coating with the coating material by coating section 21, metal plate 23 is conveyed to solidification section 22 side by conveyance section 15, and the coating film is solidified in solidification section 22 (in the present embodiment, an oven) (solidification of the coating material). In the present embodiment, from the viewpoint of preventing decomposition of the resin and the like in the coating material and forming a homogeneous coating film, metal plate 23 is preferably heated to 120° C. to 300° C., more preferably heated to 150° C. to 280° C., and still more preferably heated to 180° C. to 260° C. The heating time is not particularly limited, and from the same viewpoint as described above, it is preferably 3 to 90 seconds, more preferably 10 to 70 seconds, and still more preferably 20 to 60 seconds.

In this case, air may be blown so that the air speed at the plate surface is 0.9 m/s or more. A general coating material may contaminate solidification section 22 due to evaporation of a low-molecular-weight component in the coating material. On the other hand, in the coating material described above, the silicone resin forms a hydrogen bond to the other components. Therefore, even when the coating material is solidified under air blowing, a heating apparatus is hardly contaminated because the silicone resin is hardly evaporated.

Then, the metal plate (metal-based base material 10) having the coating film formed thereon is conveyed to flame treatment apparatus 100 side by conveyance section 15, followed by flame treatment of the coating film. The surface of the coating film formed in coating of the coating material and solidification of the coating material (these are together referred to as "coating film formation") is flame-treated by the method described above. In addition, in the present embodiment, when the surface of the coating film is flame-treated, control section 12 described above preferably determines the combustion energy so that the surface temperature of the coating film is 56° C. or more and 150° C. or less. In other words, control section 12 preferably adjusts the amount of flame radiated in flame treatment section 13 so that the surface temperature is 56° C. or more and 150° C. or less at the same time as the start of flame treatment. When the surface temperature of the coating film containing the silicone resin or the solidified product thereof exceeds 150° C., the hydrophilicity of the coating film tends to be decreased, thereby causing difficulty in sufficiently increasing the rain-streak stain resistance of the coated metal plate.

Other

The coating film is formed in the embodiment described above by using the coating material containing the silicone resin and then the coating film is flame-treated, but the type of the coating material is not limited to one containing the silicone resin, and the coating film may be formed by using a coating material containing, for example, organosilicate or the like, and then flame-treated.

Effect

The apparatus for producing a coated metal plate according to the embodiment forms the coating film on the metal plate and then flame-treating the coating film. As described above, in the apparatus for producing a coated metal plate, when the metal plate (metal-based base material) having the coating film formed thereon is flame-treated, the combustion energy is determined so that the surface temperature is 56° C. or more, and thus even when water is generated by fuel combustion, little dew condensation occurs on the surface of the coating film, thereby making it difficult to inhibit flame treatment. As a result, metal-based base material 10 can be uniformly hydrophilized, and for example, a coated metal plate or the like having the high rain-streak stain resistance can be produced.

EXAMPLES

The present invention is described in detail below with reference to examples, but the present invention is not limited to these examples.

1. Preparation of Coating Material

A high molecule polyester resin (manufactured by DIC Corporation) having a number-average molecular weight of 5,000, a glass transition temperature of 30° C., a hydroxyl value of 28 mgKOH/g was mixed with a methylated melamine resin curing agent (Cymel (registered trademark) 303 manufactured by Mitsui Cytec, Ltd.) with 90 mol % methoxy group, thereby producing a composition containing the polyester resin serving as a base and the melamine resin curing agent. The mixing ratio of the polyester resin to the methylated melamine resin curing agent was 70/30.

Then, a blocked sulfonic acid catalyst represented by a general formula below was added to the resultant composition so that the amount of sulfonic acid after removal of a blocking group was 1 mass % relative to the solid content of the coating material.

[Chem. 1]

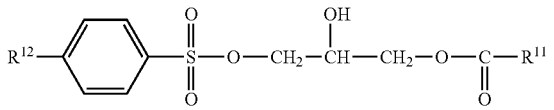

($R^{11}$ represents an alkyl group having 10 carbon atoms, and $R^{12}$ represents an alkyl group having 1 carbon atom.)

Further, a methyl/phenyl-based silicone resin having a structure represented by a table below was added so that the amount was 5 mass % relative to the total solid content of each coating material. In the table below, the "T unit" represents a structural unit derived from trialkoxysilane contained in the silicone resin, and the "D unit" represents a structural derived from dialkoxysilane. Also, in the table, the description "Methyl/phenyl" represents the ratio of a structural unit having a methyl group to a structural unit having a phenyl group. Further, the description "Amount of silanol group to amount of Si atom" represents a ratio of the amount (mol) of silanol groups to the amount (mol) of Si atoms in the silicone resin.

TABLE 1

| Weight-average molecular weight | Molecular weight distribution (Mw/Mn) | T unit/ D unit | Methyl/ phenyl | Amount of silanol group to amount of Si atom (mol %) |
|---|---|---|---|---|
| 3100 | 2.9 | 100/0 | 66/34 | 27 |

2. Evaluation

By using the coating material described above, a coated metal plate was formed as follows.

2-1. Preparation of Metal Plate

A hot-dip Zn-55% Al alloy-plated steel sheet having a thickness of 0.27 mm, A4 size (210 mm×297 mm), and a per-side plating deposition amount of 90 g/m$^2$ was prepared as a metal plate and the surface thereof was alkaline-degreased. Then, the surface was coated with a coating-type chromate treatment solution (NRC300NS manufactured by Nipponpaint Co., Ltd.) so that the Cr deposition amount was 50 mg/m$^2$. Further, the surface is coated with an epoxy resin-based primer coating material (700P manufactured by Nippon Fine Coatings Inc.) by a roll coater so that the cured film thickness was 5 μm. Then, the metal plate was baked so that the highest attained temperature of the base material was 215° C., producing a plated steel sheet having a primer coating film formed thereon (also simply referred to as a "plated steel sheet" hereinafter).

2-2. Coating Performed by Use of Coating Material

The plated steel sheet was coated with the coating material by a roll coater so that the cured film thickness was 18 μm, and then baked for 90 seconds at a plate highest attained temperature of 225° C. and a plate surface air speed of 0.9 m/s.

2-3. Flame Treatment

The coating film of the coating material was flame-treated. Specifically, the temperature (temperature before flame treatment) of the coating film of the coated metal plate before flame treatment (15 seconds before flame treatment) and outdoor air humidity were measured. The temperature of the coated steel sheet before flame treatment was 20° C. to 28° C. The absolute humidity of outdoor air was 2.2 g/m$^2$. Then, the flame combustion energy was determined by comparing the temperature before flame treatment and the outdoor air humidity with a previously formed calibration curve so that the surface temperature of the coating film of the coated metal plate was a desired temperature during flame treatment. Then, flame treatment was performed based on the determined combustion energy. The burner used for flame treatment was F-3000 manufactured by Flynn Burner Corporation (USA). A mixed gas (LP gas:outdoor air (volume ratio)=1:25) produced by mixing, in a gas mixer, LP gas (combustion gas) with outdoor air collected by a blower was used as combustible gas. In addition, the length (length denoted by L in FIG. 2A) of a flame hole of a burner head in the conveyance direction of the coating film was 4 mm. While, the length (length denoted by W in FIG. 2B) of the flame hole of the burner head in a direction perpendicular to the conveyance direction was 450 mm. Further, the distance between the flame hole of the burner head and the surface of the coating film was 20 mm. The combustion energy was adjusted by a gas flow rate. In addition, the surface temperature of the coating film of the coated metal plate after flame treatment (10 seconds before flame treatment) was measured, and it was recognized that the surface temperature of the coating film of the coated metal plate during flame treatment was possibly a desired temperature. Table 2 represents the surface temperature of the coating film of the coated metal plate after flame treatment.

TABLE 2

| | | Flame treatment conditions | | Plate temperature | | Physical properties of coating film | |
|---|---|---|---|---|---|---|---|
| No. | | Combustion energy of flame (kJ/hr/10 mm) | Treatment rate (m/min) | Temperature before flame treatment (° C.) | Temperature after flame treatment (° C.) | Contact angle with water (°) | Evaluation of rain-streak stain resistance |
| Example | 1 | 5,100 | 40 | 20 | 62 | 32 | B |
| | 2 | 5,100 | 33 | 23 | 73 | 19 | A |
| | 3 | 3,840 | 21 | 24 | 94 | 17 | A |
| | 4 | 5,100 | 20 | 26 | 110 | 19 | A |
| | 5 | 5,100 | 16 | 28 | 132 | 25 | A |
| | 6 | 5,100 | 13 | 21 | 150 | 38 | B |
| Comparative Example | 1 | 1,890 | 30 | 21 | 52 | 68 | D |
| | 2 | 2,520 | 40 | 23 | 52 | 54 | D |
| | 3 | 5,100 | 50 | 21 | 55 | 48 | D |

2-4. Test

The following tests were performed for each of the coated steel sheets formed under flame treatment conditions in examples and comparative examples. The results are represented in Table 2.

(1) Measurement of Contact Angle with Water

Measured was the contact angle with water of the coating film surface of each of the coated metal plates formed by using the coating materials prepared in the examples and the comparative examples. In measurement, droplets of 0.01 cc of purified water were formed in a constant-temperature constant-humidity room at an air temperature of 23° C.±2° C. and a relative humidity of 50%±5%, and contact angle meter DM901 manufactured by Kyowa Interface Science, Inc. was used for the measurement.

(2) Evaluation of Rain-Streak Stain Resistance

The rain-streak stain resistance was evaluated as follows.

First, each of the coated metal plates formed by using the coating materials prepared in the examples and the comparative examples was attached to a vertical exposure table. Further, a corrugated plate was attached to the upper portion of the coated metal plate so that the angle with the ground was 20°. In this case, the corrugated plate was installed so that rainwater flowed in a streak form on the surface of the coated metal plate. In this state, an outdoor exposure test was performed for 2 months, and the stain adhesion state was observed. The rain-streak stain resistance was evaluated by a difference in brightness (ΔL) of the coated metal plate before and after exposure as follows.

D: ΔL is 2 or more (noticeable stains).

C: ΔL is 1 or more and less than 2 (rain-streak stains are unnoticeable but visually recognizable).

B: ΔL is less than 1 (rain-streak stains are almost visually unrecognizable).

A: ΔL is less than 1 and rain-streak stains are visually unrecognizable at all.

In addition, "A" and "B" were recognized as acceptable.

Table 2 indicates that in the case of flame treatment with the flame combustion energy determined so that the surface temperature of the coating film exceeds 56° C. during flame treatment, the contact angle with water is sufficiently decreased, and little rain-streak stain occurs (Examples 1 to 6). It is supposed that in these examples, no dew condensation occurs during flame treatment, and flame treatment is satisfactorily performed.

While, in the case of flame treatment with the flame combustion energy determined so that the surface temperature of the coating film is less than 56° C. during flame treatment, the contact angle with water is not easily sufficiently increased (Comparative Examples 1 to 3). It is thought that in these comparative examples, flame treatment is inhibited by the dew condensation of water in the combustion gas.

The present application claims priority based on Japanese Patent Application No. 2018-011809, filed on Jan. 26, 2018. The entire contents described in the specification and drawings of this application are incorporated in the present specification.

INDUSTRIAL APPLICABILITY

According to a flame treatment apparatus and an apparatus for producing a coated metal plate of the present invention, a coated metal plate can be flame-treated without preheating treatment with causing no dew condensation of water produced by fuel combustion. Therefore, the present invention is very useful for flame treatment of various metal-based base materials with high thermal conductivity, and can be applied to, for example, production of exterior building materials of various buildings and the like.

REFERENCE SIGNS LIST

10 Metal-based base material
11 First temperature measuring section
12 Control section
13 Flame treatment section
14 Second temperature measuring section
15 Conveyance section
16 Humidity measuring section
20 Coating film forming section
21 Coating section
22 Solidification section
23 Metal plate
100 Flame treatment apparatus
132 Burner head
132*a* Housing
132*b* Flame hole
133 Gas supply pipe
200 Apparatus for producing coated metal plate

The invention claimed is:

1. A flame treatment apparatus, comprising:

a first temperature measuring section that measures a temperature before flame treatment of a metal-based base material;

a control section that, based on the temperature before flame treatment measured by the first temperature measuring section, determines flame combustion energy so that a surface temperature of the metal-based base material is 56° C. or more during flame treatment;

a flame treatment section that, based on the combustion energy determined by the control section, flame-treats the metal-based base material; and a conveyance section that conveys the metal-based base material, wherein the first temperature measuring section and the flame treatment section are disposed in this order along a conveyance direction of the conveyance section.

2. The flame treatment apparatus according to claim 1, further comprising a second temperature measuring section that measures a temperature after flame treatment of the metal-based base material, wherein:

the control section determines the combustion energy based on the temperature before flame treatment and the temperature after flame treatment.

3. The flame treatment apparatus according to claim 2, further comprising a humidity measuring section that measures outdoor air humidity, wherein:

the control section determines the combustion energy based on the outdoor air humidity, the temperature before flame treatment, and the temperature after flame treatment.

4. An apparatus for producing a coated metal plate, comprising:

a coating film forming section that forms a coating film by coating a metal plate with a coating material; and the flame treatment apparatus according to claim 1, wherein:

the flame treatment apparatus performs flame treatment of the coating film formed by the coating film forming section.

5. A method for producing a coated metal plate, comprising:

forming a coating film on a metal plate having a thermal conductivity of 10 W/mK or more by coating the metal plate with a coating material;

first measuring a temperature of the metal plate including the coating film formed on the metal plate; and determining flame combustion energy based on the temperature measured in the first measuring of the temperature so that a surface temperature of the coating film is 56° C. or more during flame treatment and then performing flame treatment.

6. The method for producing a coated metal plate according to claim 5, wherein:

the flame treatment includes determining the combustion energy based on the temperature measured in the first measuring of the temperature and the thermal conductivity of the metal plate.

7. The method for producing a coated metal plate according to claim 5, wherein:

the flame treatment is performed so that the surface temperature of the coating film is 56° C. or more and 150° C. or less during the flame treatment.

8. The method for producing a coated metal plate according to claim 5, further comprising second measuring the temperature of the metal plate including the coating film formed on the metal plate after the flame treatment, wherein:

the flame treatment includes determining the combustion energy based on at least the temperature measured in the first measuring of the temperature and the temperature measured in the second measuring of the temperature.

9. The method for producing a coated metal plate according to claim 8, further comprising measuring outdoor air humidity, wherein:

the flame treatment includes determining the combustion energy based on at least the temperature measured in the first measuring of the temperature, the temperature measured in the second measuring of the temperature, and the humidity measured in the measuring of the humidity.

10. The method for producing a coated metal plate according to claim 5, wherein:

the flame treatment is performed while the metal plate including the coating film formed on the metal plate is conveyed in a constant direction; and the flame treatment includes determining the combustion energy based on at least the temperature measured in the first measuring of the temperature and conveyance speed of the metal plate.

11. The method for producing a coated metal plate according to claim 5, wherein:

the flame treatment includes determining the combustion energy based on at least the temperature measured in the first measuring of the temperature and a type of a combustion gas supplied during the flame treatment.

12. The method for producing a coated metal plate according to claim 5, wherein:

the coating material contains a silicone resin.

* * * * *